US005340181A

United States Patent [19]

Matsuyama

[11] Patent Number: 5,340,181

[45] Date of Patent: Aug. 23, 1994

[54] HOOK APPARATUS FOR LIFTING A HEAVY OBJECT

[76] Inventor: Sumiko Matsuyama, 3-2-713 Higashisuma 1-chome, Koto-ku, Tokyo, 135, Japan

[21] Appl. No.: 112,996

[22] Filed: Aug. 30, 1993

[30] Foreign Application Priority Data

Sep. 11, 1992 [JP] Japan ..... 4-267923

[51] Int. Cl.[5] ..... B66C 1/36

[52] U.S. Cl. ..... 294/82.33; 294/82.2

[58] Field of Search .... 294/82.13, 82.17, 82.19–82.21, 294/82.17, 82.31–82.34, 101, 104; 24/598.4, 598.7, 599.1, 599.5, 599.9, 600.1–600.3, 601.5

[56] References Cited

U.S. PATENT DOCUMENTS

| | | | |
|---|---|---|---|
| 1,847,819 | 3/1932 | Davies | 294/82.31 X |
| 1,956,786 | 5/1934 | Bemis | 294/82.21 |
| 3,722,943 | 3/1973 | Kalua | 294/82.2 |
| 3,741,600 | 6/1973 | Crook | 294/82.2 |
| 4,309,052 | 1/1982 | Drayton | 294/82.2 |

FOREIGN PATENT DOCUMENTS

| | | | |
|---|---|---|---|
| 5-39188 | 2/1993 | Japan | 294/82.31 |

*Primary Examiner*—Johnny D. Cherry
*Attorney, Agent, or Firm*—Lowe, Price, LeBlanc & Becker

[57] ABSTRACT

A hook apparatus used to lift, convey and release a heavy structural member, e.g., an iron plate. The hook apparatus includes a hook support (1) having a fall preventing portion (11) at the distal end thereof and a wire securing portion (12) at the proximal end thereof, and a hook (3) having an proximal end portion which has a bifurcated structure including a pair of branched end portions (32 and 32'). The hook (3) is pivotably attached to the hook support (1) through a connecting pin (2) which extends between the branched end portions (32 and 32') and through a central portion (13) of the hook support (1) which is disposed in the space defined between the branched end portions (32 and 32'). A lock (4) is disposed in the space defined between the branched end portions (32 and 32') of the hook (3) to cooperate with the central portion (13) of the hook support (1) to lock the hook support (1) and the hook (3) to each other. The hook (3) is pivotable through approximately 180° reversely relative to the hook support (1) when the hook support (1) and the hook (3) are unlocked from each other by disengaging the lock (4). The hook apparatus further includes a removal assisting lock (6) for assisting the removal of the hook apparatus from the object of lifting. The removal assisting lock (6) includes a lock body (61) disposed on the hook support (1), and an engagement member (62) disposed on the hook (3). Thus, it is possible to lift, convey and release a heavy structural member extremely safely and efficiently.

6 Claims, 7 Drawing Sheets

HOOK APPARATUS FOR LIFTING A HEAVY OBJECT

BACKGROUND OF THE INVENTION

1. Field of the Invention

The present invention relates to a hook apparatus which is used to lift a heavy object, e.g., an iron plate, a block member, etc., at a construction site or the like.

More particularly, the present invention relates to a hook apparatus specially used for lifting a heavy object being hooked, which is designed to be capable of reliably and readily hooking and lifting such a heavy object without danger of falling and of being readily removed from the object.

2. Description of the Related Art

Hitherto, heavy iron plates (e.g., several tons) have been used at many construction sites where they are laid out on the ground to form curing scaffolding for soft ground it is frequently necessary to move such plates, depending upon the type of work at the construction site. To move the plates, a lifting operation is conducted with a crane or the like.

More specifically, the operation of lifting and moving an iron plate used as the above-described scaffolding is carried out with a wire passed through a lifting hole that is provided in a desired portion of the iron plate. The wire is engaged with a hook to pull the wire, thereby lifting and moving the iron plate.

Conventional hooks generally used for the above operation of lifting the iron plates (also known as sole plates) are of different types, such as:

(i) In one conventional hook structure, a fall preventing plate is disposed on the hook body in such a manner that the plate is biased by resilient force to abut against the distal end portion of the hook, and the width of the opening at the distal end portion of the hook is set at an extremely small value. Needless to say, the reason why the opening width at the distal end portion of the hook is made small is to prevent disengagement of the wire from the hook as much as possible;

(ii) In another conventional hook structure, a hook comprises a hook support and a hook member, which are two separate members capable of pivoting relative to each other. It should be noted that when a heavy object is lifted, the respective distal end portions of the hook support and the hook member abut against each other to function as a fall preventing mechanism.

However, this type of conventional hook structure is also used in such a way that a wire attached to an iron plate is engaged with the hook member; therefore, the width of the opening which is defined at the hook distal end portion between the hook support and the hook member when pivoted relative to each other is extremely small for the same reason as above.

In field work, however, heavy labor is required for the operation of engaging a wire with an iron plate laid out, which is as heavy as several tons. Therefore, the worker is apt to insert the engagement portion of the hook (i.e., the hook distal end portion) directly into a hole provided in the iron plate to lift it. In such a case, however, it is extremely difficult to engage the hook with the iron plate because the opening width at the hook distal end portion is extremely small, as described above. In other words, when an object, e.g., an iron plate, which has been laid out on the ground is to be lifted up by engaging the hook directly with the iron plate, the hook cannot readily be engaged with the iron plate because the opening width of the conventional hook is extremely small. Even if the hook is successfully engaged with the iron plate, it is still difficult to disengage the hook from the iron plate after the iron plate has been relocated.

Properly speaking, hooks having no fall preventing device must not be used for the operation of the type described above, but in many work sites hooks which are equipped with no fall preventing device and which have a large opening width are used in the present state of art.

However, it is considerably dangerous to use a hook which is equipped with no fall preventing device and which has a wide opening for such an operation.

More specifically, when an iron plate (as a heavy object) is being lifted with a hook having no fall preventing device, there is substantially no possibility of the hook disengaging from the iron plate, but when the iron plate is lowered onto the ground so as to be installed thereon, a play is likely to be produced between the hook and the hole for lifting due to slacking of the lifting wire. Thus, undesired disengagement of the hook from the hole frequently occurs. Once the hook disengages from the hole, the iron plate will fall down, inviting danger of people being crushed to death under the iron plate. In actuality, there have been many fatal accidents caused by falling iron plates at work sites of the kind described above.

The present inventor conducted exhaustive studies in order to solve the above-described problems of the prior art.

As a result, the present inventor has found that if a hook apparatus has such a structure that a hook that is pivotably attached to a hook support is capable of pivoting approximately 180° reversely from a locked position (in which the distal end portion of the hook is held in united relation to a fall preventing portion of the hook support to maintain a locked state) when it is unlocked, that is, if the distal end portion of the hook and the fall preventing portion of the hook support can be opened relative to each other much wider than in the prior art, it is possible to facilitate insertion of the distal end portion of the hook into an engagement hole provided in a heavy object, e.g., an iron plate or the like laid out on the ground, when the hook is to be engaged with such a heavy object to lift it, and there is no likelihood that the fall preventing portion will abut on or be buried in the ground during the operation of disengaging the hook from the heavy object, thus enabling the hook to be disengaged from the heavy object extremely smoothly without meeting with any obstacle. On the basis of this finding, the present inventor has previously proposed a hook apparatus with a novel structure (see Japanese Patent Application No. 3-216524).

Particularly, the hook apparatus for lifting a sole plate, which has previously been proposed by the present inventor, exhibits advantageous effects in the process of hooking and lifting a sole plate which has been laid out with the hook and moving it to a predetermined place. That is, the proposed hook apparatus has great advantages in that the hook can be readily and reliably engaged with a hole for lifting provided in the sole plate, and that it is possible to surely prevent the fall of the plate during conveyance, and further that there is no likelihood of the hook disengaging from the sole plate even if the lifting rope slacks when the plate being hooked is lowered to the place where it is to be laid out.

However, the proposed hook apparatus still has some difficulties in removing the hook apparatus from the sole plate after it has been conveyed and laid out in a predetermined place.

As has been described above, the proposed hook apparatus has no likelihood that the fall preventing portion of the hook support will abut on or be buried in the ground or other object when the sole plate being hooked is lowered to where it is to be laid out. Therefore, the fall preventing portion does not interfere with the subsequent operation of disengaging the hook from the plate. However, since the disengaging operation depends on the worker, it is not easy to remove the whole hook apparatus from the sole plate, which is as heavy as several tons, apart from the advantage in terms of the structure of the fall preventing portion.

Under the above-described circumstances, it is an object of the present invention to provide an improvement of the hook apparatus previously proposed by the present inventor, particularly a hook apparatus having a mechanism for facilitating the removal of the hook apparatus from a sole plate or other heavy object.

SUMMARY OF THE INVENTION

The present invention provides a hook apparatus (F) adapted to be attached to a distal end of a wire of a lifting machine to lift a heavy object. The hook apparatus (F) includes a hook support (1) having a fall preventing portion (11) at a distal end thereof and a wire securing portion (12) at a proximal end thereof, and a hook (3) having a proximal end portion which has a bifurcated structure including a pair of branched end portions (32 and 32'). The hook (3) is pivotably attached to the hook support (1) through a connecting pin (2) which extends between the branched end portions (32 and 32') and through a central portion (13) of the hook support (1) which is disposed in the space defined between the branched end portions (32 and 32'). The hook apparatus (F) further includes a lock (4) adapted to lock the hook support (1) and the hook (3) to each other when the fall preventing portion (11) of the hook support (1) and the distal end portion (31) of the hook (3) are placed substantially in contact with each other. The lock (4) is disposed in the space defined between the branched end portions (32 and 32') and engageable with a locking surface which is radially outwardly spaced from the connecting pin. The hook (3) is pivotable through approximately 180° relative to the hook support (1) so that the hook support (1) and the hook (3) have a positional relationship to each other in which a back portion (33) of the hook (3) can abut on a side (15) of the hook support (1) when the hook support (1) and the hook (3) are unlocked from each other by disengaging the lock (4). Furthermore, the hook apparatus (F) includes a removal assisting lock (6) for assisting removal of the hook apparatus (F) from the heavy object by maintaining the above-described positional relationship, in which the back portion (33) of the hook (3) can abut on the side (15) of the hook support (1). The removal assisting lock (6) includes a lock body (61) disposed on the hook support (1), and an engagement portion (62) disposed on the hook (3) to engage the lock body (61).

As has been described above, the present invention relates to the improvement of the hook apparatus previously proposed by the present inventor (see Japanese Patent Application No. 3-216524).

The most significant feature of the present invention resides in that the previously proposed hook apparatus is improved to enable the hook apparatus to be readily removed from a sole plate (as a heavy object) without imposing a heavy load on the worker after the plate has been conveyed and laid out in a predetermined place.

The hook apparatus of the present invention has been developed in view of the following points:

(1) The hook apparatus previously proposed by the present inventor premises that it will be used with a crane.

(2) Accordingly, the power of the crane can be used to remove the hook apparatus from a sole plate, which is as heavy as several tons, without depending on the power of the worker.

(3) Hence, it is useful to invent a specific mechanism for effectively using the crane power for removal of the hook apparatus from the sole plate.

The specific mechanism is the above-described removal assisting lock (6). The hook support (1), the hook (3), the lock (4), and the arrangement of the hook (3) are the essential constituent features of the hook apparatus previously proposed by the present inventor.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and of which.

DESCRIPTION OF THE PREFERRED EMBODIMENT

The technical construction of the present invention will be described below in detail by way of one embodiment and with reference to the accompanying drawings. It should be noted that the present invention is not limited to the illustrated embodiment.

Figure 1:
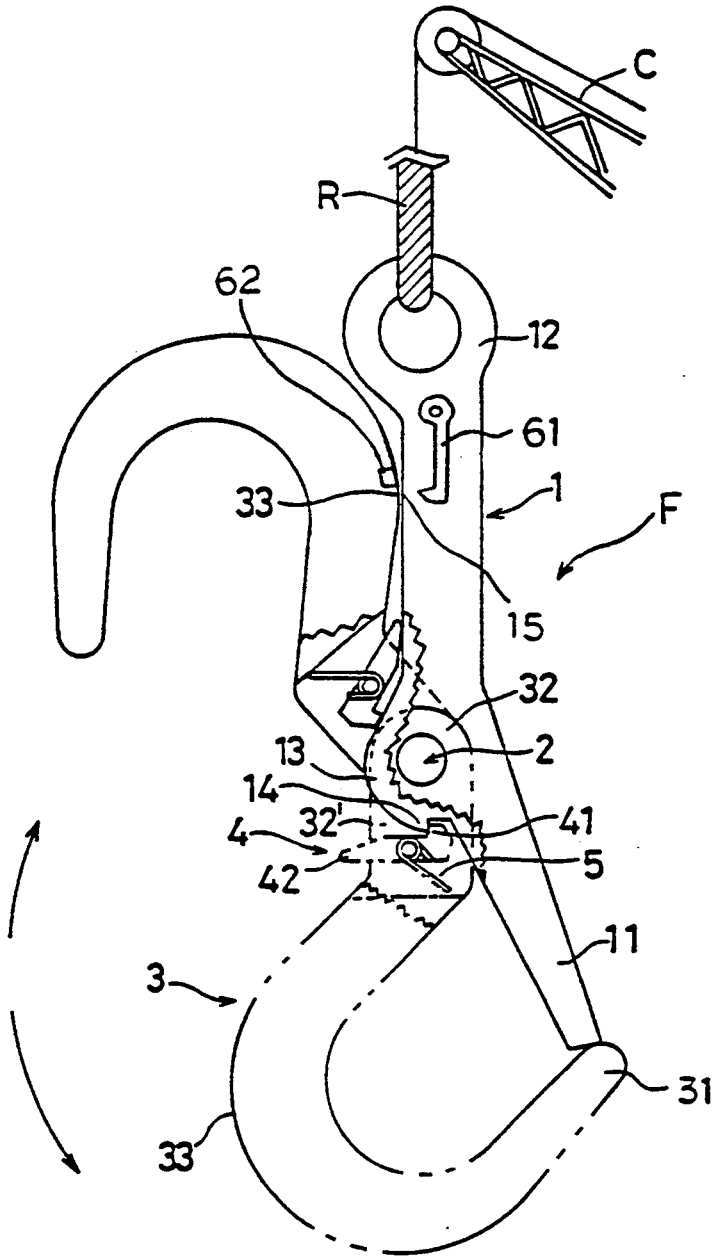
FIG. 1 is a front view of a hook apparatus according to one embodiment of the present invention.

FIG. 1 is a front view illustrating the structure of a hook apparatus according to one embodiment of the present invention.

As illustrated, the hook apparatus F principally comprises a hook support 1, a hook 3, a lock 4, and a removal assisting lock 6.

It should be noted that since the proximal end portion of the hook 3 has a bifurcated structure, as described later, in FIG. 1 the structure of the bifurcate portion is shown with a part thereof cut out, and FIG. 1 shows the hook 3 which is in a locked position (phantom line) and also in an unlocked position (solid line) when the hook 3 has been pivoted approximately 180° reversely from the locked position.

The hook support 1 in the present invention has a fall preventing portion 11 at the distal end thereof and a wire securing portion 12 at the proximal end thereof for securing a wire rope R that is connected to a take-up mechanism provided on a crane C. The hook support 1 in the illustrated example comprises a single plate made of steel.

In addition, an approximately central portion 13 of the hook support 1 from which the fall preventing portion 11 projects is rotatably fitted in the space defined between a pair of branched end portions 32 and 32′ constituting the bifurcated proximal end portion of the hook 3, and it is pivotably supported by a connecting pin 2 which extends between the branched end portions 32 and 32′ of the hook 3.

Further, the central portion 13 of the hook support 1 is provided with a recess 14 which cooperates with the lock 4, which is disposed in the space defined between the branched end portions 32 and 32′ of the hook 3, as described later, to lock the hook support 1 and the hook 3 together and unlock them from each other. It is preferable for the central portion 13 to have a configuration with a circular projection, as illustrated, for the cooperation with the lock 4, as a matter of course.

The hook 3 in the present invention has a hook distal end portion 31 which cooperates with the fall preventing portion 11 of the hook support 1 to prevent a heavy object, e.g., an iron plate, from falling when the hook apparatus F is in a locked state, a back portion 33, and a bifurcated proximal end portion including a pair of branched end portions 32 and 32′ which define a space adequate to rotatably receive the central portion 13 of the hook support 1 and to accommodate the lock 4 (described later). As illustrated, the hook 3 is shaped so that the branched end portions 32 and 32′, the back portion 33 and the distal end portion 31 define in combination the desired hook configuration.

The lock 4 in the present invention is disposed in the space defined between the branched end portions 32 and 32′ the hook 3 such that the lock 4 abuts against the central portion 13 of the hook support 1, as illustrated.

The lock 4 is arranged to maintain a locked state of the hook apparatus F. That is, when the fall preventing portion 11 of the hook support 1 and the distal end portion 31 of the hook 3 are placed substantially in contact with each other, the lock 4 maintains the contacting relation between the two portions 11 and 31. For example, the locked state is attained by the following structure of the lock 4. However, the present invention is not limited thereto.

The distal end portion 41 of the lock 4 is shaped to be engageable with the recess 14 provided in the central portion 13 of the hook support 1. The lock 4 is disposed in the space defined between the branched end portions 32 and 32′ of the hook 3, and the lock 4 is biased to abut against the central portion 13 of the hook support 1 by resilient force from a spring 5, as illustrated. More specifically, the end portion 41 of the lock 4 is engaged with the recess 14 provided in the central portion 13 of the hook support 1 by the resilient force from the spring 5, thereby maintaining the locked state stably by the cooperation of the fall preventing portion 11 of the hook support. 1 and the distal end portion 31 of the hook 3. It should be noted that the lock 4 is pivotably supported by a pin 43 (not shown in FIG. 1) which extends between the branched end portions 32 and 32′ of the hook 3 so that the lock 4 is accommodated stably in the space between the branched end portions 32 and 32′. Further, the spring 5 is disposed by housing the pin 43 so that it is always possible to obtain resilient force with which the end portion 41 of the lock 4 is kept in contact with the central portion 13 of the hook support 1.

The first significant feature of the hook apparatus according to the present invention resides in that when the hook apparatus F is unlocked, the opening defined between the distal end portion 31 of the hook 3 and the fall preventing portion 11 of the hook support 1 can be set to an extremely large width, i.e., approximately 180°.

FIG. 1 also shows a state wherein the hook 3 has been pivoted approximately 180° reversely from the locked position with the lock 4 disengaged from the recess 14 to unlock the hook apparatus F. Such a state can be attained easily in the present invention. That is, when the lock 4 is disengaged from the recess 14 to unlock the hook apparatus F, for example, by turning the operating lever 42 of the lock 4 in a direction counter to its own gravity, the hook 3 can be reversely pivoted approximately 180°, as illustrated. At this time, as the angle of pivoting of the hook 3 increases, the operating lever 42 of the lock 4 is gradually received into the space defined between the branched end portions 32 and 32′ of the hook 3 by virtue of the peripheral configuration (i.e., circular configuration) of the central portion 13 of the hook support 1. In the present invention, it is preferable for the back portion 33 of the hook 3 to be capable of abutting on the side 15 of the hook support 1 with a view to maximizing the opening width. Accordingly, any structural element of the hook support 1 which may interfere with the reverse pivoting of the hook 3 should be avoided. For example, it is preferable to contrive optimal disposition of the connecting pin 2 about which the hook 3 pivots, or to receive the operating lever 42 of the lock 4, which projects from the branched end portions 32 and 32′ of the hook 3, into the space defined between the branched end portions 32 and 32′, as described above. Further, it is preferable to provide the side 15 of the hook support 1 at a position asymmetric with respect to the wire securing portion 12, as shown in FIG. 1.

The second significant feature of the hook apparatus according to the present invention resides in the removal assisting lock 6 for assisting removal of the hook apparatus F from a heavy object, e.g., a sole plate. That is, when the hook 3 is reversely pivoted approximately 180° from the locked position with the lock 4 disengaged from the recess 14 and thus placed in positional relation to the hook support 1 in which the back portion 33 of the hook 3 can abut on the side 15 of the hook support 1, as shown in FIG. 1, the removal assisting lock 6 maintains the above positional relation, thereby facilitating the removal of the hook apparatus F from the heavy object.

As shown in FIG. 1, the removal assisting lock 6 includes a lock body 61 disposed on the hook support 1, and an engagement portion 62 disposed on the hook 3.

It should be noted that the structure of the removal assisting lock 6 in the present invention is not necessarily limited to that shown in FIG. 1, and that there is no particular restriction on the lock structure as long as the removal assisting lock 6 can assist the above-described removal operation. In addition, the lock body 61 may be disposed on either or each side of the hook support 1. The engagement portion 62 is disposed in corresponding and cooperating relation to the lock body 61.

The significance of the first and second features of the present invention will be mentioned in the following description of the method of using the hook apparatus F of the present invention, made with reference to FIGS. 2 to 8.

FIGS. 2 to 8 are views illustrating the method of using the hook apparatus F having the structure shown in FIG. 1. In these figures, the spring 5 and other elements are omitted for simplification of the illustration.

Figure 2:
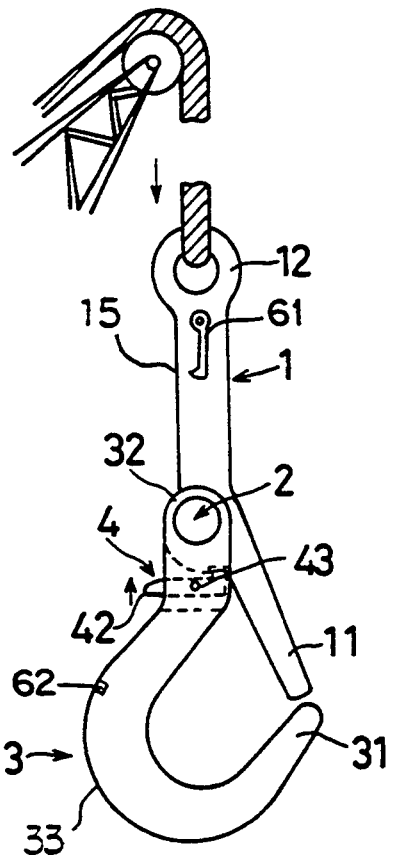
FIG. 2 shows a first stage of a lifting operation carried out using the hook apparatus of the present invention.

FIG. 2 shows a state wherein the distal end of the wire rope R of the crane C is attached to the wire securing portion 12 of the hook apparatus F.

Figure 3:
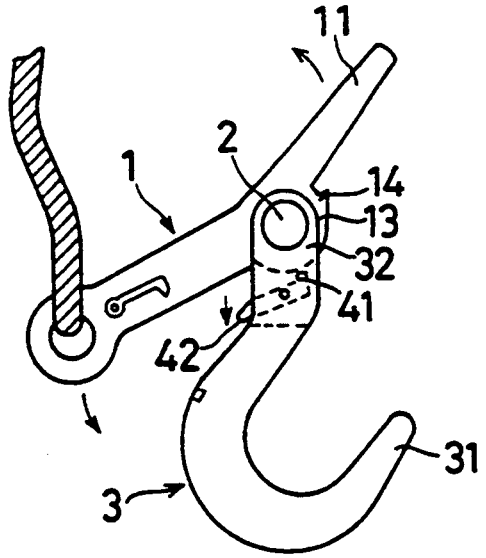
FIG. 3 shows a stage of the lifting operation carried out using the hook apparatus of the present invention, in which the opening width is enlarged.

FIG. 3 shows a state wherein the operating lever 42 of the lock 4 is moved upwardly (in the direction of the arrow in FIG. 2) to unlock the hook apparatus F in order to lift up an iron plate I, thereby allowing the fall preventing portion 11 and the distal end portion 31 to open wide. FIG. 3 also shows the operating lever 42 of the lock 4 which is conveniently received in the space defined between the branched end portions 32 and 32' of the hook 3.

Figure 4:
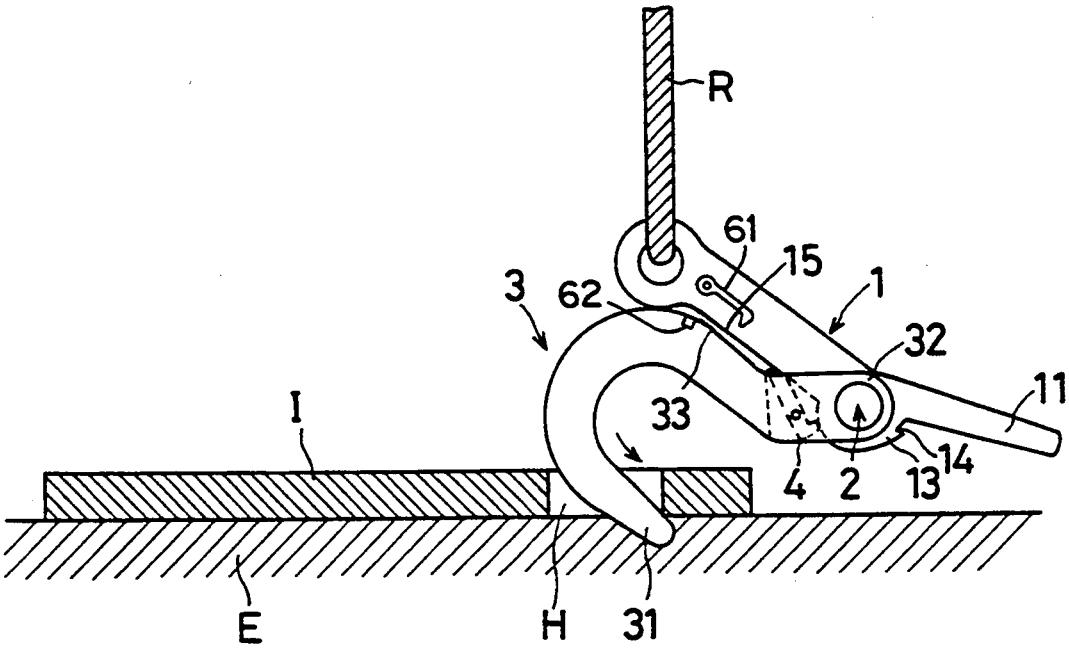
FIG. 4 shows a stage of the lifting operation carried out using the hook apparatus of the present invention, in which a hook is engaged with a hole in an iron plate.

FIG. 4 shows a state wherein the distal end portion 31 of the hook 3 is inserted into the area between a hole H provided in the iron plate I and the ground E without the fall preventing portion 11 of the hook support 1 abutting against the ground E. FIG. 4 also shows the operating lever 42 of the lock 4 which has already been received in the space defined between the branched end portions 32 and 32' of the hook 3.

Figure 5:
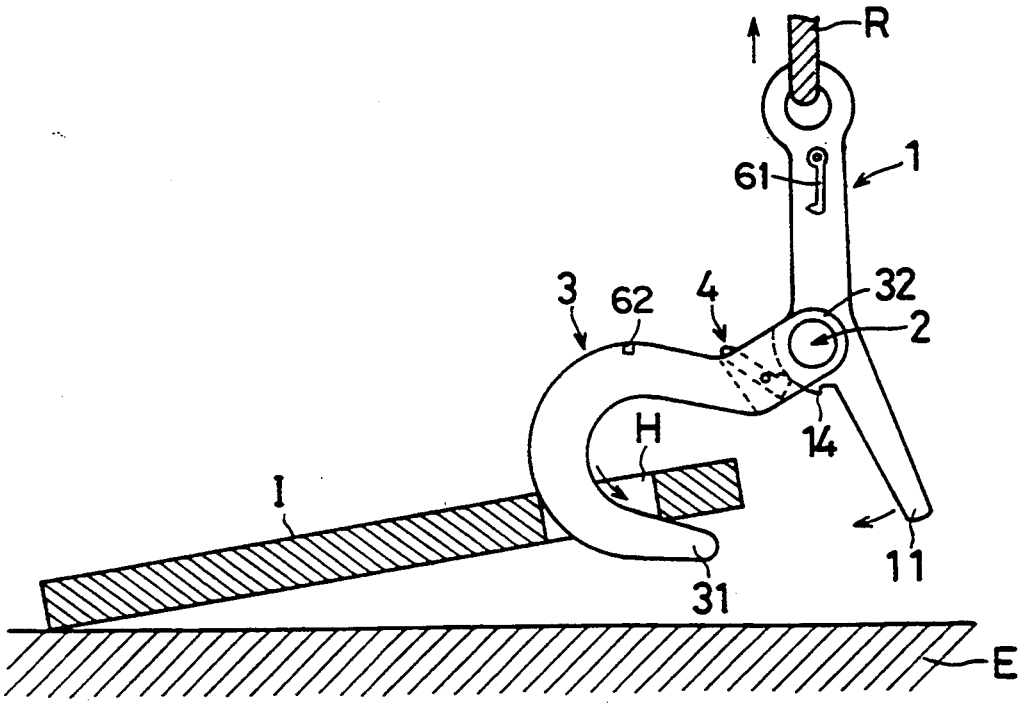
FIG. 5 shows the initial stage of the operation of lifting the iron plate using the hook apparatus of the present invention.

FIG. 5 shows a state wherein as the iron plate I is gradually lifted up by the lifting operation of the crane C, the hook support 1 erects and rises, thus causing the hook 3 to pivot in the closing direction and hence bite into the hole H in the iron plate I. At this time, as the iron plate I is lifted up, the fall preventing portion 11 of the hook support 1 and the distal end portion 31 of the hook 3 move toward each other, as shown by the arrows, thereby gradually approaching the locked position.

Figure 6:
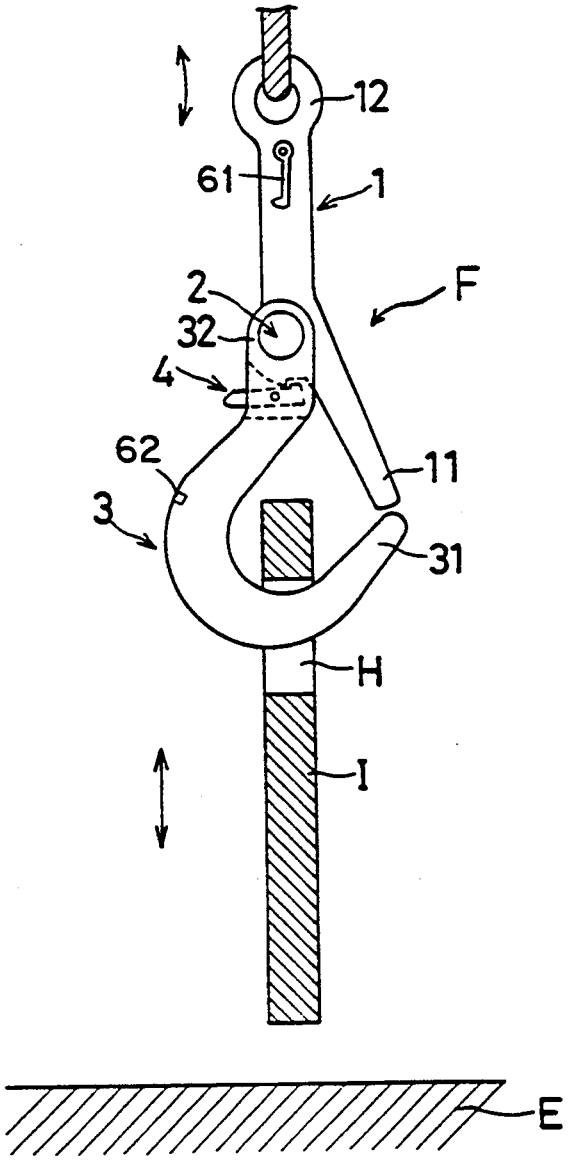
FIG. 6 shows the final stage of the lifting operation in which the iron plate has been completely lifted up using the hook apparatus of the present invention.

FIG. 6 shows a state wherein the iron plate I has been completely lifted up from the ground E by the lifting operation of the crane C. At this time, the end portion 41 of the lock 4 is completely engaged with the recess 14 in the central portion 13 of the hook support 1, so that the distal end portion 31 of the hook 3 and the fall preventing portion 11 of the hook support 1 reach a completely locked state.

The operations that are carried out thereafter to lay out the iron plate I and to remove the hook apparatus F from the plate I can be performed safely and easily by virtue of the hook apparatus F of the present invention.

Figure 7:
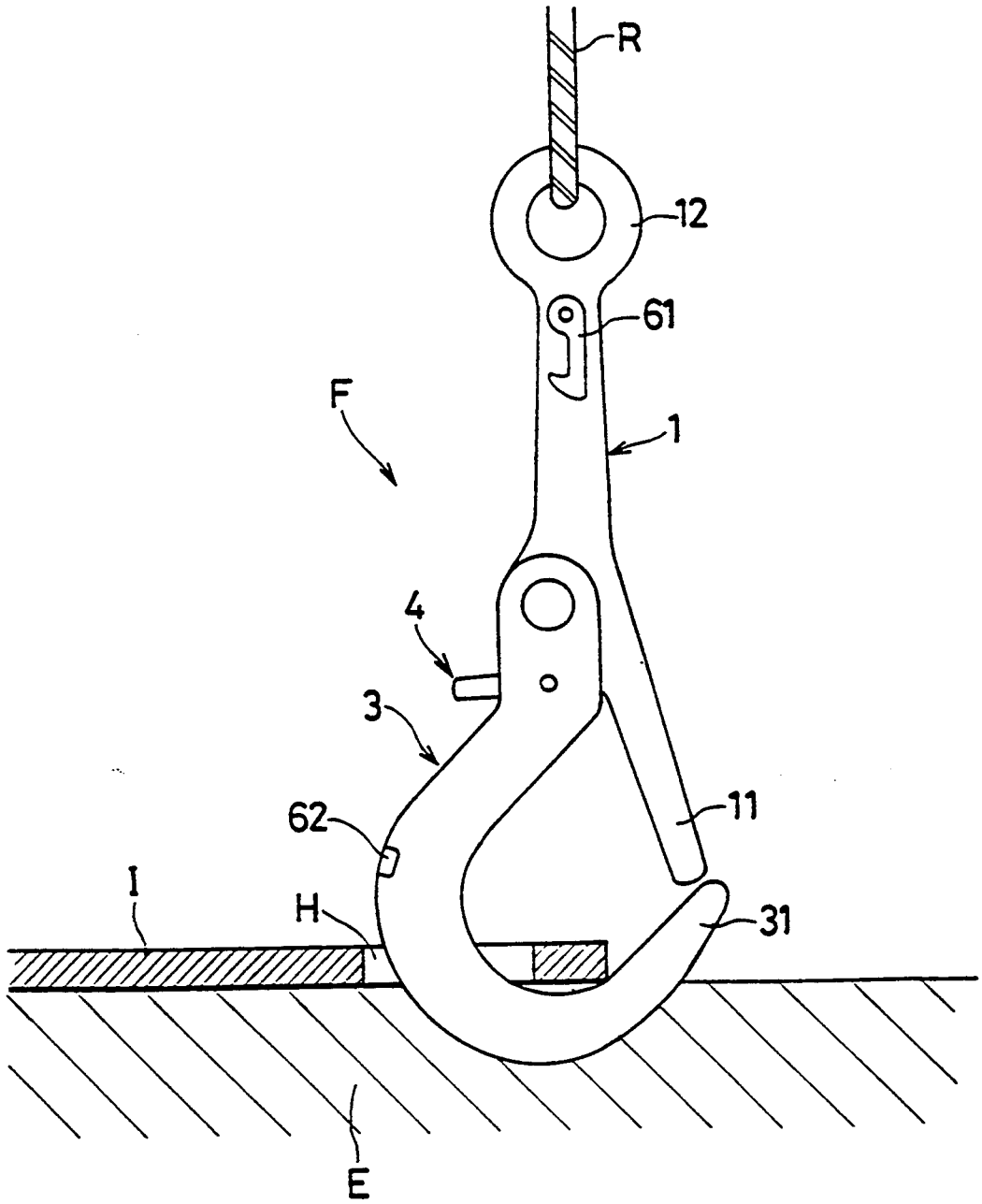
FIG. 7 shows a state wherein the iron plate has been laid out in a predetermined place by using the hook apparatus of the present invention.

FIG. 7 shows a state wherein the iron plate I has just been laid out on the ground E in the desired place. In this state, a part of the hook 3 is buried in the ground E, as illustrated in the figure, and the buried part of the hook 3 is pressed by the iron plate I, which is as heavy as several tons. Therefore, it will put a great deal of load on the worker to disengage the distal end portion 31 of the hook 3 from the hole H in the iron plate I by pivoting the lock 4 upwardly in the state shown in FIG. 7 to thereby unlock the hook support 1 and the hook 3 from each other, and then reversely pivoting the fall preventing portion 11 of the hook support 1 to enlarge the opening width between the fall preventing portion 11 and the distal end portion 31.

Figure 8:
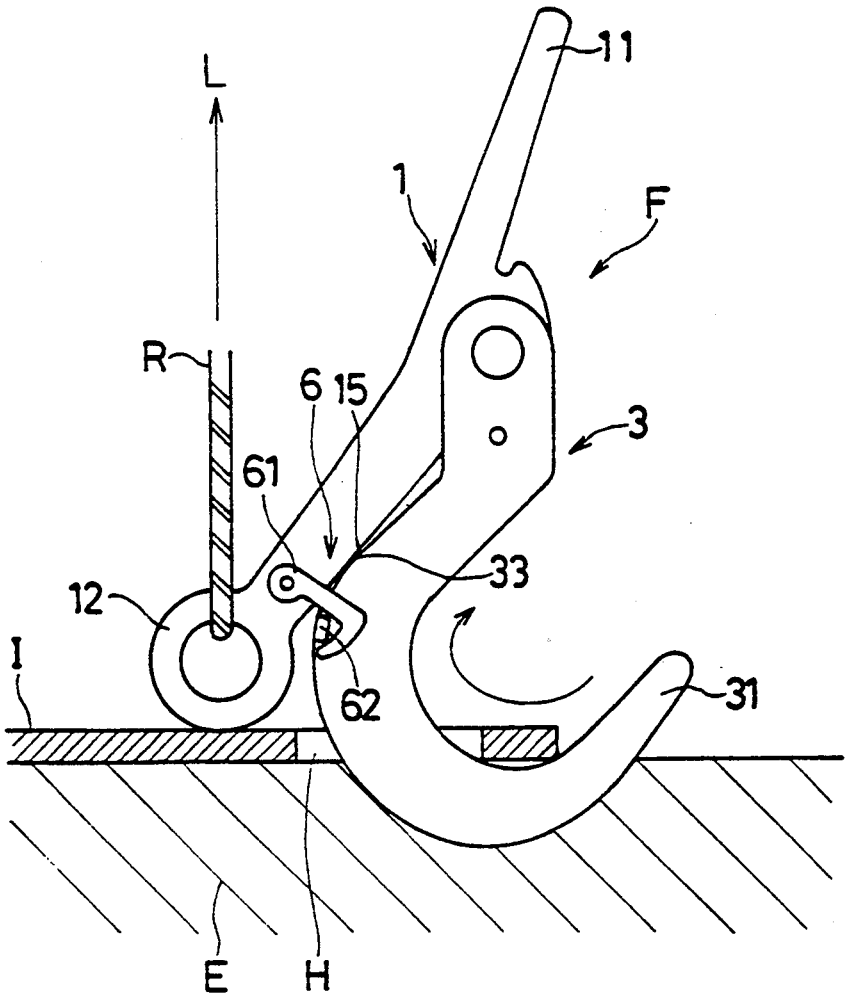
FIG. 8 shows a way in which the hook apparatus of the present invention is removed from the iron plate laid out.

FIG. 8 explains the reason why the removal assisting lock 6 facilitates the operation of removing the hook apparatus F from the iron plate I laid out.

The hook apparatus F can be shifted from the state shown in FIG. 7 to the state shown in FIG. 8 as follows: (a) In the state shown in FIG. 7, the lock 4 is pivoted upwardly to unlock the hook support 1 and the hook 3 from each other, and then the fall preventing portion 11 of the hook support 1 is pivoted reversely, as has been described above. (b) Then, the side 15 of the hook support 1 is brought into contact with the back portion 33 of the hook 3, and the removal assisting lock 6 is actuated. That is, the lock body 61, which is disposed on the hook support 1, is engaged with the engagement portion 62, which is disposed on the hook 3.

Then, the hook apparatus F is lifted up with the crane through the wire rope R as shown by the arrow L in FIG. 8. Consequently, the hook apparatus F rotates in the direction of the arrow shown in the figure. That is, it is possible to remove the hook apparatus F from the laid iron plate I extremely easily by the power of the crane, used to lift the iron plate I, without imposing a heavy load on the worker.

The following is a supplementary explanation of the reason why the hook 3 can be removed (disengaged) extremely easily with the hook apparatus F of the present invention, which will be made with reference to FIGS. 9 and 10.

Figure 9:
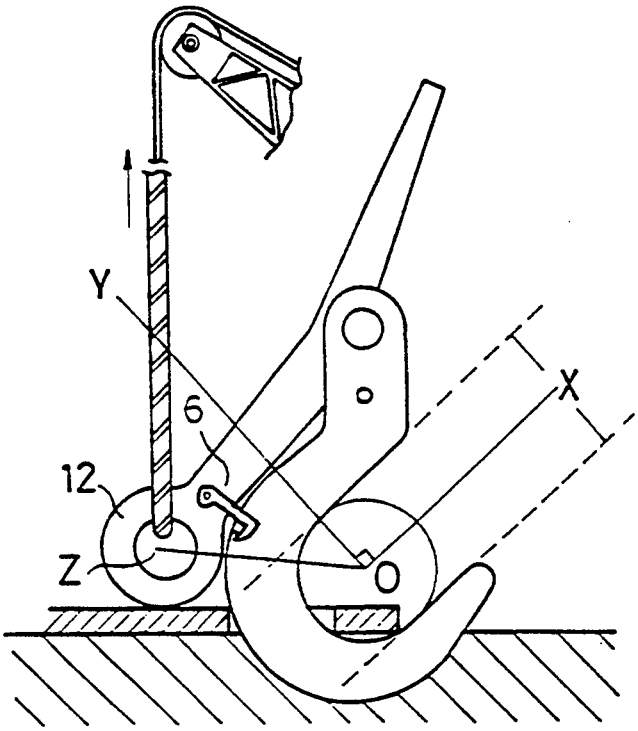
FIG. 9 is a first view for explanation of the principle of hook removing (disengaging) operation carried out with the hook apparatus of the present invention.

FIG. 9 shows an inscribed circle with a central point O which is inscribed in the opening of the hook 3 placed in the state shown in FIG. 8, a segment OX extending radially outwardly from the central point O through a point on the inscribed circle which is at the middle of the opening width (equivalent to the diameter of the inscribed circle), a segment OY intersecting perpendicularly to the segment OX, and a segment OZ connecting the central point Z of the wire securing portion 12 of the hook support 1 and the central point O of the inscribed circle.

Figure 10:
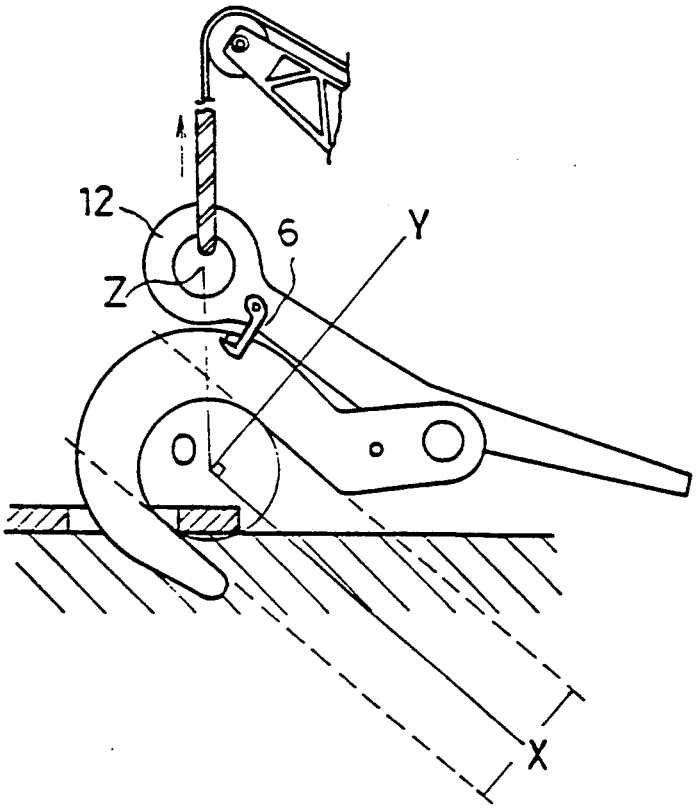
FIG. 10 is a second view for explanation of the principle of hook removing (disengaging) operation carried out with the hook apparatus of the present invention.

FIG. 10 shows the positional relationship between the above-described segments in the final stage of the hook removing process (in which the state of the hook apparatus is similar to that shown in FIG. 4; however, FIG. 4 shows the initial stage of lifting the iron plate I).

As will be clear from FIGS. 9 and 10, the angle ZOX is larger than the angle XOY (90°). Therefore, in the hook apparatus of the present invention the hook 3 is always subjected to force so as to come out of (disengage from) the hole of the iron plate I. It is important in order to ensure the hook removing (disengaging) action that the hook support 1 and the hook 3 have a positional relationship to each other in which the back portion 33 of the hook 3 and the side 15 of the hook support 1 abut on each other when the hook 3 is reversely pivoted to the full, i.e., approximately 180°. In the example shown in FIGS. 9 and 10, it is necessary that the segment OZ lie outwardly of the segment OY and the angle ZOX be wider than the angle YOZ (90°).

Although in the foregoing the operation of lifting a heavy iron plate has been explained as an applied example of the hook apparatus F according to the present invention, it should be noted that the present invention can also effectively be applied to operations of lifting various kinds of heavy structural members, e.g., heavy block members, as a matter of course.

According to the hook apparatus of the present invention, it is possible to lift, convey and release various kinds of heavy structural members, e.g., iron plates, extremely safely and efficiently.

More specifically, the hook apparatus of the present invention is arranged so that the fall preventing portion and the hook distal end portion can be opened relative to each other much wider than in the prior art, and it is therefore possible to engage the hook with a hole (engagement opening) provided in a heavy structural member, e.g., an iron plate, extremely easily and reliably. In addition, since the hook distal end portion and the fall preventing portion are locked to each other as one unit, there is no danger of such a heavy structural member disengaging from the hook during the operation of lifting, conveying and lowering the heavy structural member. Further, the hook can be disengaged from the structural member extremely easily because the fall preventing portion and the hook distal end portion can be opened relative to each other satisfactorily wide and by virtue of the function of the removal assisting lock mechanism.

Thus, the hook apparatus of the present invention can prevent occurrence of an accident caused by the fall of a heavy structural member, e.g., an iron plate, due to disengagement of the hook during the operation of lifting such a heavy structural member. Accordingly, it is possible to improve the safety in operations at work sites, which is a significant feature of the present invention. In addition, since the hook apparatus can be removed from a heavy structural member extremely easily, the present invention provides superior operatability.

Although the present invention has been described through specific terms, it should be noted here that the described embodiment is not necessarily exclusive and that various changes and modifications may be imparted thereto without departing from the scope of the invention which is limited solely by the appended claims.

What is claimed is:

1. A hook apparatus (F) adapted to be attached to a distal end of a wire of a lifting machine to lift a heavy object, said hook apparatus (F) comprising:

(i) a hook support (1) having a fall preventing portion (11) at a distal end thereof and a wire securing portion (12) at a proximal end thereof;

(ii) a hook (3) having a proximal end portion which has a bifurcated structure including a pair of branched end portions (32 and 32'), said hook (3) being pivotably attached to said hook support (1) through a connecting pin (2) which extends between said branched end portions (32 and 32') and through a central portion (13) of said hook support (1) which is disposed in a space defined between said branched end portions (32 and 32');

(iii) a lock (4) adapted to lock said hook support (1) and said hook (3) to each other when said fall preventing portion (11) of said hook support (1) and a distal end portion (31) of said hook (3) are placed substantially in contact with each other, said lock (4) being disposed in the space defined between said branched end portions (32 and 32') and being engageable with a locking surface which is radially outwardly spaced from the connecting pin;

(iv) said hook (3) being pivotable through approximately 180° relative to said hook support (1) so that said hook support (1) and said hook (3) have a positional relationship to each other in which a back portion (33) of said hook (3) can abut on a side (15) of said hook support (1) when said hook support (1) and said hook (3) are unlocked from each other by disengaging said lock (4); and (v) a removal assisting lock (6) for assisting removal of said hook apparatus (F) from the heavy object by maintaining said positional relationship, in which said back portion (33) of said hook (3) can abut on said side (15) of said hook support (1), said removal assisting lock (6) including a lock body (61) disposed on said hook support (1), and an engagement portion (62) disposed on said hook (3) to engage said lock body (61).

2. A hook apparatus according to claim 1, wherein said lock (4) is biased to abut against said central portion (13) of said hook support (1) by resilient force from a spring (5) .

3. A hook apparatus according to claim 2, wherein said lock (4) is engageable at an end portion (41) thereof with a recess (14) which defines said locking surface and is provided in said central portion (13) of said hook support (1) to lock said hook support (1) and said hook (3).

4. A hook apparatus according to claim 2, wherein said lock (4) has an operating lever (42) which projects from said branched end portions (32 and 32') of said hook (3) when said hook support (1) and said hook (3) are locked to each other by said lock (4).

5. A hook apparatus according to claim 4, wherein said operating lever (42) of said lock (4) is received in the space defined between said branched end portions (32 and 32') of said hook (3) when said hook support (1) and said hook (1) are unlocked from each other by disengaging said lock (4) and said hook (3) is pivoted reversely in a direction in which said back portion (33) of said hook (3) approaches said side (15) of said hook support (1).

6. A hook apparatus according to claim 1, wherein said removal assisting lock (6) includes said lock body (61) disposed in the vicinity of said wire securing portion (12) of said hook support (1).

* * * * *